US011107401B1

(12) United States Patent
Xue

(10) Patent No.: US 11,107,401 B1
(45) Date of Patent: Aug. 31, 2021

(54) PIXEL DRIVING CIRCUIT, DRIVING METHOD THEREOF, AND DISPLAY PANEL

(71) Applicant: SHENZHEN CHINA STAR OPTOELECTRONICS SEMICONDUCTOR DISPLAY TECHNOLOGY CO., LTD., Guangdong (CN)

(72) Inventor: Yan Xue, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 16/968,616

(22) PCT Filed: Apr. 23, 2020

(86) PCT No.: PCT/CN2020/086449
§ 371 (c)(1),
(2) Date: Aug. 10, 2020

(30) Foreign Application Priority Data

Mar. 13, 2020 (CN) ..... 202010174566.1

(51) Int. Cl.
*G09G 3/3233* (2016.01)

(52) U.S. Cl.
CPC ..... *G09G 3/3233* (2013.01); *G09G 2300/043* (2013.01); *G09G 2300/0809* (2013.01); *G09G 2310/08* (2013.01); *G09G 2320/0247* (2013.01); *G09G 2330/028* (2013.01)

(58) Field of Classification Search
None
See application file for complete search history.

(56) References Cited

U.S. PATENT DOCUMENTS

| | | | | |
|---|---|---|---|---|
| 6,611,107 | B2 * | 8/2003 | Mikami | G09G 3/3233 257/59 |
| 2009/0015744 | A1 * | 1/2009 | Sekine | G09G 3/3659 349/39 |
| 2011/0298531 | A1 | 12/2011 | Shah et al. | |
| 2012/0188150 | A1 | 7/2012 | Shirouzu et al. | |
| 2014/0111563 | A1 * | 4/2014 | Hwang | H04N 13/398 345/691 |
| 2014/0232703 | A1 * | 8/2014 | Tatara | G09G 3/3233 345/204 |
| 2018/0033370 | A1 | 2/2018 | Zheng | |
| 2018/0053795 | A1 | 2/2018 | Lan | |
| 2019/0164481 | A1 * | 5/2019 | Yuan | G09G 3/3266 |

FOREIGN PATENT DOCUMENTS

| | | | |
|---|---|---|---|
| CN | 102354532 | A | 2/2012 |
| CN | 102652332 | A | 8/2012 |
| CN | 103996373 | A | 8/2014 |
| CN | 106886111 | A | 6/2017 |
| CN | 107665672 | A | 2/2018 |
| CN | 107799062 | A | 3/2018 |
| CN | 108877655 | A | 11/2018 |
| CN | 110136646 | A | 8/2019 |

* cited by examiner

*Primary Examiner* — Dorothy Harris

(57) ABSTRACT

A pixel driving circuit, a driving method thereof, and a display panel are provided. The pixel driving circuit includes a first thin film transistor T1, a second thin film transistor T2, a third thin film transistor T3, a fourth thin film transistor T4, a fifth thin film transistor T4, a bootstrap capacitor Cbt, and an organic light emitting component.

10 Claims, 5 Drawing Sheets

PIXEL DRIVING CIRCUIT, DRIVING METHOD THEREOF, AND DISPLAY PANEL

FIELD OF INVENTION

The present disclosure relates to the field of display technology, and particularly relates to a pixel driving circuit, a driving method thereof, and a display panel.

BACKGROUND OF INVENTION

Currently, as illustrated in FIG. 1, three-transistor one-capacitor (3T1C) external compensation circuits are generally used on pixel circuits of large-sized active matrix organic light emitting diode (AMOLED) panels. The circuits can compensate a variation situation of a threshold voltage Vth of a driving transistor T1 to ensure evenness of an electric current flowing through an organic light emitting component. A deficiency of the circuit is that it cannot compensate the threshold voltage Vth of transistor switches. If the threshold voltage Vth of a switching thin film transistor (TFT) T2 of a panel is negatively biased, it is difficult to stably store a data voltage in a storage capacitor C. As the data is gradually lost, this causes flickering on a screen on a macroscopic scale, severely affecting product quality.

Influences of negative biasing (Vth Shift) on the threshold voltage of the switching transistor T2 on a gate voltage (Vg), a source electrode (VS), and an OLED electric current (IDLED) of the driving transistor T1 are simulated in FIG. 2. When the threshold voltage Vth of the switching transistor T2 is negatively biased at 5V, the data signal is gradually lost, causing the electric current of the light emitting diode to be lowered instantly. By the collected brightness of the used light emitting diodes, it can be understood that after the light emitting diodes of each frame emit light in a short time (peak), their brightness is lowered instantly. This indicates that the electric current of the light emitting diodes is lowered instantly, and that there is severe data signal loss.

SUMMARY OF INVENTION

A purpose of the present disclosure is to provide a pixel driving circuit, a driving method thereof, and a display panel to solve the technical problem existing in the prior art, that is, when the threshold voltage is a negative voltage, luminescence brightness of the light emitting diodes are lowered instantly, and data signals are loss severely.

In order to realize the purpose mentioned above, the present disclosure provides a pixel driving circuit, including: a first thin film transistor T1, a second thin film transistor T2, a third thin film transistor T3, a fourth thin film transistor T4, a fifth thin film transistor T4, a bootstrap capacitor Cbt, and an organic light emitting component; specifically, a gate electrode of the first transistor T1 is connected to a first node G, a source electrode of the first transistor T1 is connected to a second node S, and a drain electrode of the first transistor T1 is configured to receive a power source voltage VDD; a gate electrode of the second transistor T2 is configured to receive a writing signal WR, a source electrode of the second transistor T2 is connected to a third node N, and a drain electrode of the second transistor T2 is connected to the first node G; a gate electrode of the third transistor T3 is connected to the gate electrode of the second transistor T2 and is configured to receive the writing signal WR, a source electrode of the third transistor T3 is configured to receive a data signal Data, and a drain electrode of the third transistor T3 is connected to the third node N; a gate electrode of the fourth transistor T4 is configured to receive an enabling signal EM, a source electrode of the fourth transistor T4 is connected to the third node N, and a drain electrode of the fourth transistor T4 is configured to receive the power source voltage VDD; a gate electrode of the fifth transistor T5 is configured to receive a read signal RD, a source electrode of the fifth transistor T5 is configured to receive a sensing signal Ref, a drain electrode of the fifth transistor T5 is connected to the second node S; one end of the bootstrap capacitor Cbt is connected to the first node G, and another end of the bootstrap capacitor Cbt is connected to the second node S; and an anode of the organic light emitting component is connected to the second node S, and a cathode of the organic light emitting component is connected to a ground voltage VSS.

Furthermore, the first transistor T1, the second transistor T2, the third transistor T3, the fourth transistor T4, and the fifth transistor T5 are any of a low-temperature polycrystalline-silicon thin film transistor, an oxide semiconductor thin film transistor, or an amorphous silicon thin film transistor.

Furthermore, the writing signal WR and the read signal RD are provided by an external time schedule controller.

Furthermore, the first transistor T1 provides a constant driving electric current to the organic light emitting component.

In order to realize the purpose mentioned above, the present disclosure further provides a driving method of a pixel driving circuit that can drive the driving circuit mentioned above. The driving method of the pixel driving circuit includes following steps of:

an initial stage, wherein the pixel driving circuit is initialized;

a data input stage, wherein the gate electrode of the fourth transistor T4 is received an enabling signal EM with high electric potential, the fourth transistor T4 transmits the power source voltage VDD to the third node N under control of the enabling signal EM, and a threshold voltage of the first transistor is stored in the bootstrap capacitor Cbt; and a light emitting stage, wherein the pixel driving circuit generates a driving electric current and provides the driving electric current to the organic light emitting component for driving light emitting display of the organic light emitting component.

Furthermore, the data input stage includes steps of:

a first stage, wherein in the data input stage, the writing signal WR, the read signal RD, and the data signal Data obtain high electric potentials; the enabling signal EM and the sensing signal Ref are low electric potentials; the first transistor T1, the second transistor T2, the third transistor T3, and the fifth transistor T5 are turned on, and the fourth transistor T4 is kept turned off; the data signal Data is written to the first node G; and the sensing signal Ref is written to the second node S; and a second stage, wherein the writing signal WR is pulled down to a low electric potential from the high electric potential, the second transistor T2 and the third transistor T3 are turned off, meanwhile, the enabling signal EM is raised to high electric potential, the power source voltage VDD is written to the third node N, and a driving voltage is kept at the second node S.

Furthermore, the driving voltage is 1V.

Furthermore, when entering the light emitting stage from the data input stage, the read signal RD is pulled down to the low electric potential from the high electric potential, the fifth transistor T5 is turned off, electric potentials of the first node G and the second node S are raised simultaneously, an electric current passes through the first transistor T1 and flows through the organic light emitting component, and the organic light emitting component continuously emits light.

Furthermore, in the light emitting stage, the writing signal WR, the read signal RD, and the data signal Data obtain low electric potentials, and the organic light emitting component emits light.

A display panel includes the pixel driving circuit mentioned above.

Beneficial effect of the present disclosure is to provide a pixel driving circuit, driving method thereof, and a display panel. By reasonably adding the third transistor T3 and the fourth transistor T4 to transmit the power source voltage VDD to the third node N, a drain electric current of the second transistor T2 is can be reduced to be small, and severe negative biasing (Vth shift) is unable to generate on the threshold voltage. The evenness of the electric current flowing through the organic light emitting component is ensured, the data signal loss is prevented, occurrence of flickering of the organic light emitting component is prevented, and normal display of the screen is ensured.

DETAILED DESCRIPTION OF PREFERRED EMBODIMENTS

The technical solutions in the embodiments of the present disclosure are clearly and completely described in the following with reference to the accompanying drawings in the embodiments of the present disclosure. Obviously, the described embodiments are only part of the embodiments of the present disclosure, but are not all embodiments of the present disclosure. All other embodiments obtained by those skilled in the art based on the embodiments of the present disclosure without creative efforts are within the scope of the present disclosure.

In the description of the present disclosure, unless specified or limited otherwise, terms "mounted," "connected," "coupled," and the like are used in a broad sense, and may include, for example, fixed connections, detachable connections, or integral connections; may also be mechanical or electrical connections or may be communication between each other; may also be direct connections or indirect connections via intervening structures; may also be inner communications of two elements or may be a relationship of interaction between two elements. For persons skilled in the art in this field, the specific meanings of the above terms in the present disclosure can be understood with specific cases.

Figure 1:
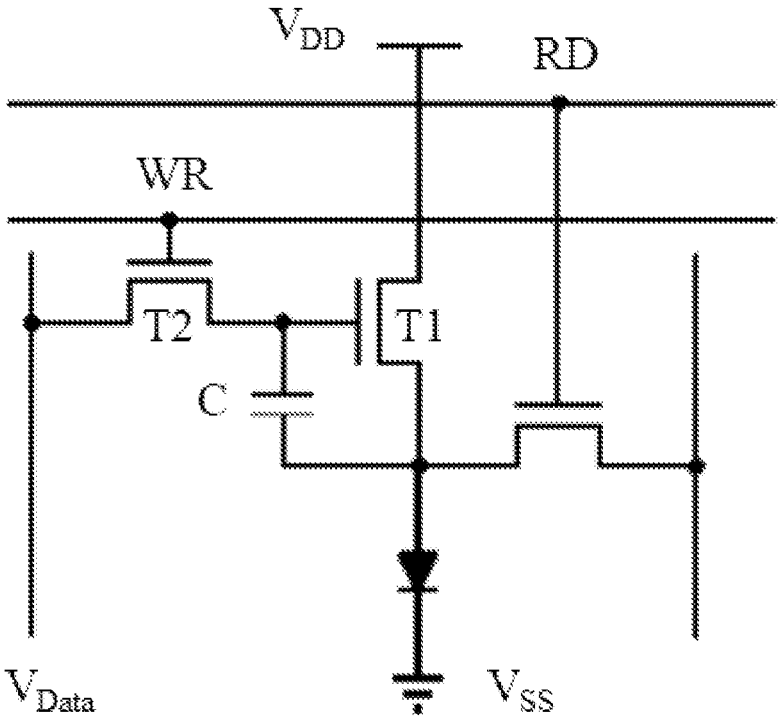
FIG. 1 (PRIOR ART)
FIG. 1 is a structural schematic diagram of a three-transistor one-capacitor (3T1C) pixel driving circuit in the prior art.
Figure 2:
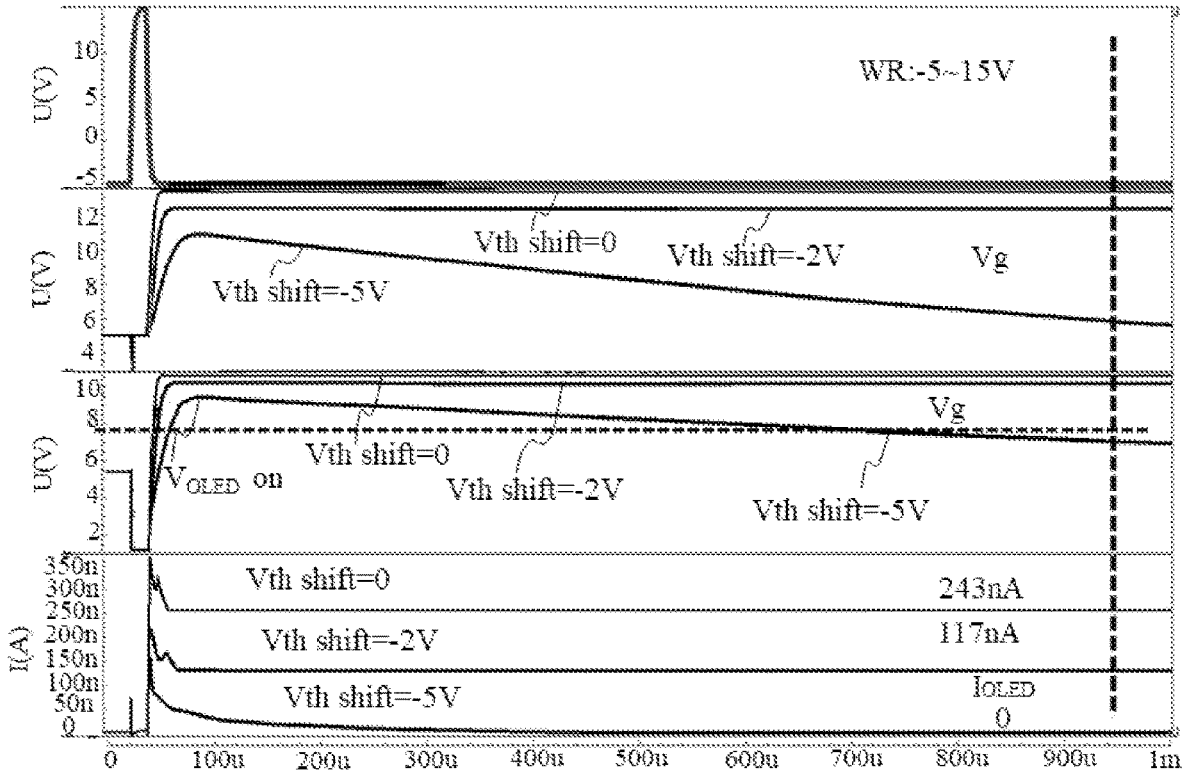
FIG. 2 (PRIOR ART)
FIG. 2 is a time sequence diagram of simulating influences of negative biasing (Vth shift) of a threshold voltage Vth of a switching transistor T2 on a gate voltage (Vg) on a driving transistor T1, a source electrode (VS), and an organic light emitting diode (OLED) electric current ($I_{OLED}$) in FIG. 1.
Figure 3:
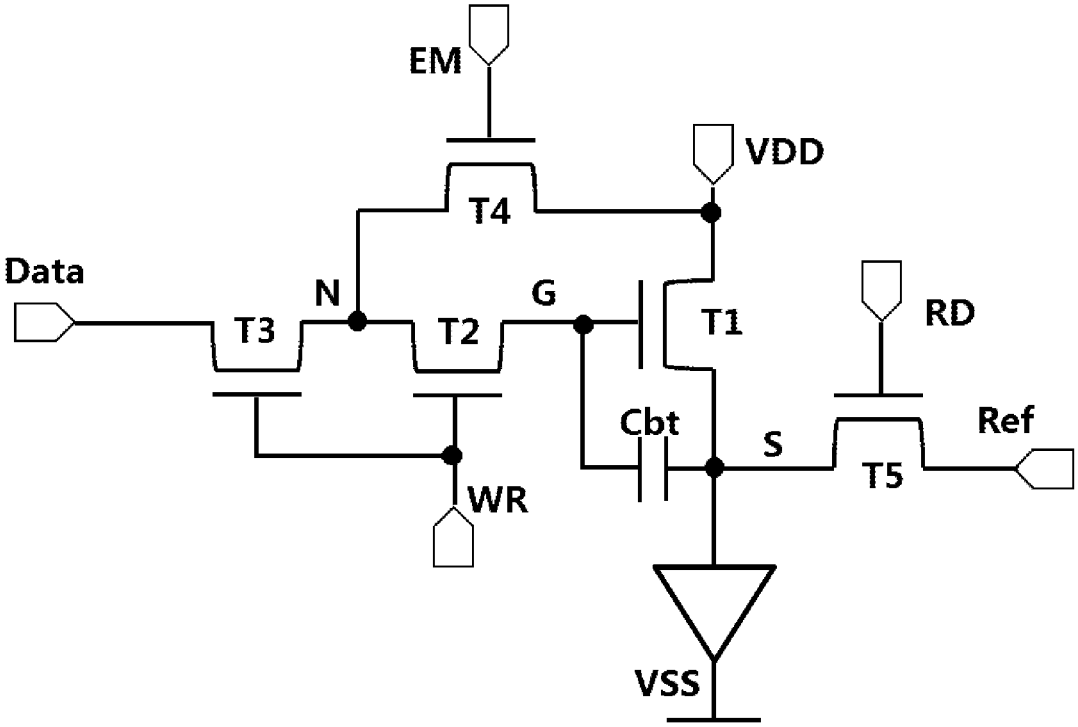
FIG. 3 is a structural schematic diagram of a pixel driving circuit of an embodiment.

As illustrated in FIG. 3, this embodiment provides a pixel driving circuit, which is a five-transistor one-capacitor (5T1C) structure and includes a first thin film transistor T1, a second thin film transistor T2, a third thin film transistor T3, a fourth thin film transistor T4, a fifth thin film transistor T4, a bootstrap capacitor Cbt, and an organic light emitting component. Specifically, a gate electrode of the first transistor T1 is connected to a first node G, a source electrode of the first transistor T1 is connected to a second node S, and a drain electrode of the first transistor T1 is configured to receive a power source voltage VDD. A gate electrode of the second transistor T2 is configured to receive a writing signal WR, a source electrode of the second transistor T2 is connected to a third node N, and a drain electrode of the second transistor T2 is connected to the first node G. A gate electrode of the third transistor T3 is connected to the gate electrode of the second transistor T2 and is configured to receive the writing signal WR, a source electrode of the third transistor T3 is configured to receive a data signal Data, and a drain electrode of the third transistor T3 is connected to the third node N. A gate electrode of the fourth transistor T4 is configured to receive an enabling signal EM, a source electrode of the fourth transistor T4 is connected to the third node N, and a drain electrode of the fourth transistor T4 is configured to receive the power source voltage VDD. A gate electrode of the fifth transistor T5 is configured to receive a read signal RD, a source electrode of the fifth transistor T5 is configured to receive a sensing signal Ref, and a drain electrode of the fifth transistor T5 is connected to the second node S. One end of the bootstrap capacitor Cbt is connected to the first node G, and another end of the bootstrap capacitor Cbt is connected to the second node S. An anode of the organic light emitting component is connected to the second node S, and a cathode of the organic light emitting component is connected to a ground voltage VSS.

Specifically, the power source voltage VDD is a high electric potential, and the ground voltage VSS is a low electric potential.

The first transistor T1 is a driving transistor and provides a constant driving electric current to the organic light emitting component.

The second transistor T2 is a switching transistor, which has the gate electrode configured to receive the writing signal WR, the source electrode configured to receive the data signal Data, and the drain electrode connected to the first node G, and is electrically connected to the first transistor T1 and the bootstrap capacitor Cbt. Furthermore, the writing signal WR and the read signal RD are provided by an external time schedule controller.

The bootstrap capacitor Cbt is connected between the first node G and the second node S and is used for maintaining a predetermined voltage in one frame time.

The fifth transistor T5 is a sensing transistor, which is controlled by the read signal RD applied on a gate electrode node, thereby applying a voltage that is supplied to the sensing signal Ref by the ground voltage VSS to the second node S. Furthermore, the read signal RD is provided by the external time schedule controller.

By reasonably adding the third transistor T3 and the fourth transistor T4 to transmit the power source voltage VDD to the third node N, this embodiment reduces the drain electric current of the second transistor T2, and prevents the generation of severe negative biasing (Vth shift) on the threshold voltage, ensuring the evenness of the electric current flowing through the organic light emitting component, preventing data signal loss and occurrence of flickering of the organic light emitting components, and ensuring a normal display of the screen.

In this embodiment, the first transistor T1, the second transistor T2, the third transistor T3, the fourth transistor T4, and the fifth transistor T5 are any one of a low-temperature polycrystalline-silicon thin film transistor, an oxide semiconductor thin film transistor, or an amorphous silicon thin film transistor. The writing signal and the read signal are provided by the external time schedule controller.

Figure 4:
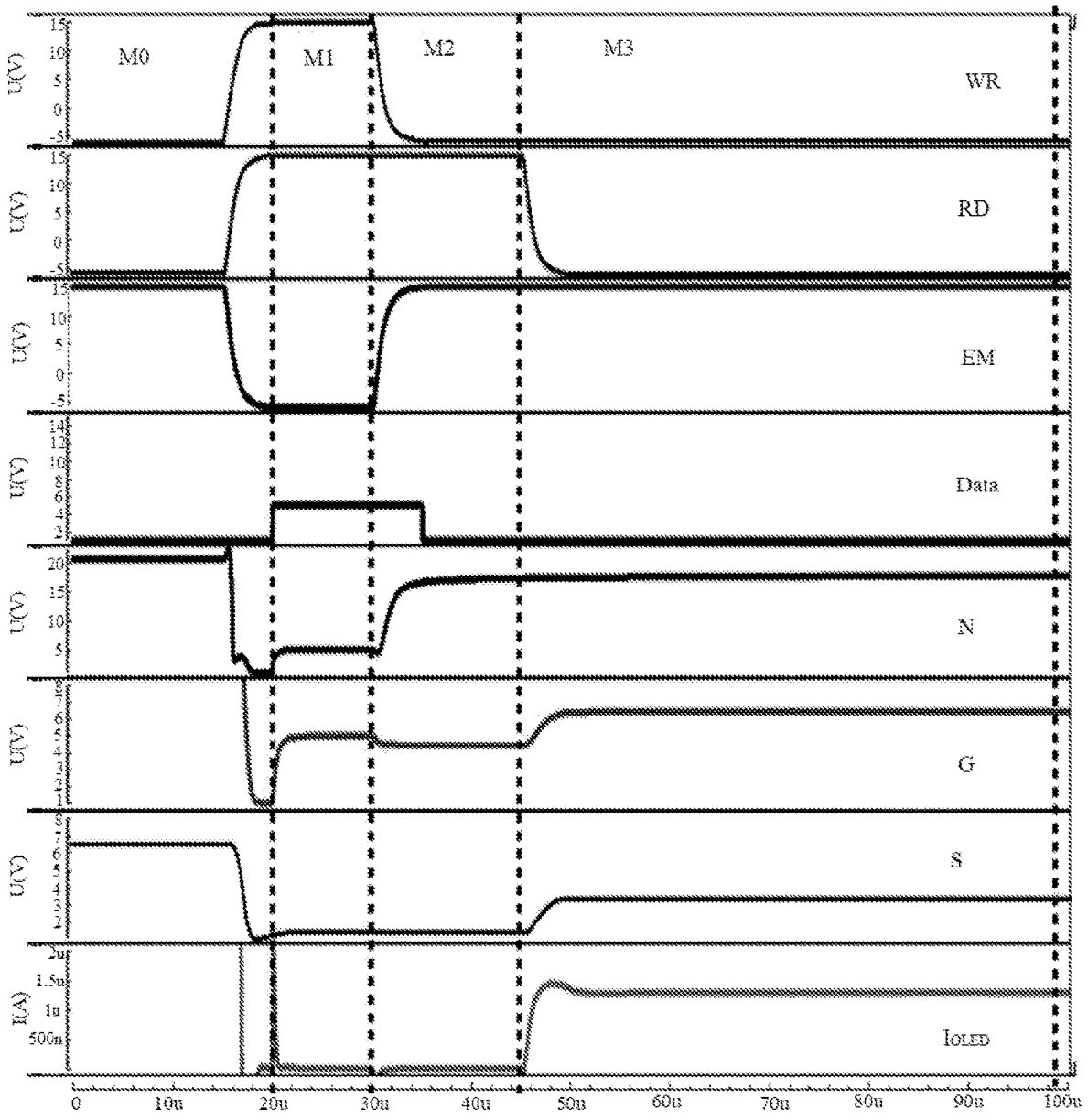
FIG. 4 is a time sequence diagram of the pixel driving circuit of an embodiment.

This embodiment further provides a driving method able to drive the pixel driving circuit mentioned above. FIG. 4 is a time sequence diagram of the pixel driving circuit of this embodiment.

Specifically, combined with the time sequence diagram of FIG. 4, the driving method of the pixel driving circuit includes following steps:

an initial stage M0, wherein the pixel driving circuit is initialized;

data input stages M1 and M2, wherein the gate electrode of the fourth transistor T4 is configured to receive an enabling signal EM with high electric potential, the fourth transistor T4 transmits the power source voltage VDD to the third node N under control of the enabling signal EM, and a threshold voltage of the first transistor is stored in the bootstrap capacitor Cbt; and a light emitting stage M3, wherein the pixel driving circuit generates a driving electric current which is provided to the organic light emitting component for driving a light emitting display of the organic light emitting component.

In this embodiment, during the data input stages M1 and M2, the writing signal WR, the read signal RD, the data signal Data, and the sensing signal Ref obtain high electric potentials, and the first transistor T1, the second transistor T2, and the third transistor T3 are conducted, and the bootstrap capacitor Cbt is charged.

In this embodiment, the data input stages M1 and M2 includes steps of:

a first stage M1, wherein in the data input stage, the writing signal WR, the read signal RD, and the data signal Data obtain high electric potentials, the enabling signal EM and the sensing signal Ref are at low electric potentials, the first transistor T1, the second transistor T2, the third transistor T3, and the fifth transistor T5 are turned on, and the fourth transistor T4 is kept off, the data signal Data is written to the first node G, and the sensing signal Ref is written to the second node S, and a second stage M2, wherein the writing signal WR is pulled down to a low electric potential from the high electric potential, the second transistor T2 and the third transistor T3 are turned off, meanwhile, the enabling signal EM is raised to the high electric potential, the power source voltage VDD is written to the third node N, and a driving voltage is kept at the second node S.

In this embodiment, the driving voltage is 1V.

In this embodiment, when entering the light emitting stage M3 from the data input stage M1, M2, the read signal RD is pulled down to the low electric potential from the high electric potential, the fifth transistor T5 is turned off, electric potentials of the first node G and the second node S are raised simultaneously, an electric current passes through the first transistor T1 and flows through the organic light emitting component, and the organic light emitting component continuously emits light. Because the gate electrode voltage (Vgs) and the drain electrode voltage of the second transistor T2 are low, the leakage current of the second transistor T2 is small. Therefore, the leakage current on the first node G is small, and the electric current of the organic light emitting component can be maintained. Therefore, the evenness of the electric current flowing through the organic light emitting component is ensured, negative biasing of the threshold voltage of the switching transistor does not cause data signal loss, preventing occurrence of flickering of the organic light emitting components, thus ensuring the normal display of the screen.

Furthermore, in the light emitting stage, the writing signal WR, the read signal RD, and the data signal Data obtain low electric potentials, and the organic light emitting component emits light.

Figure 5:
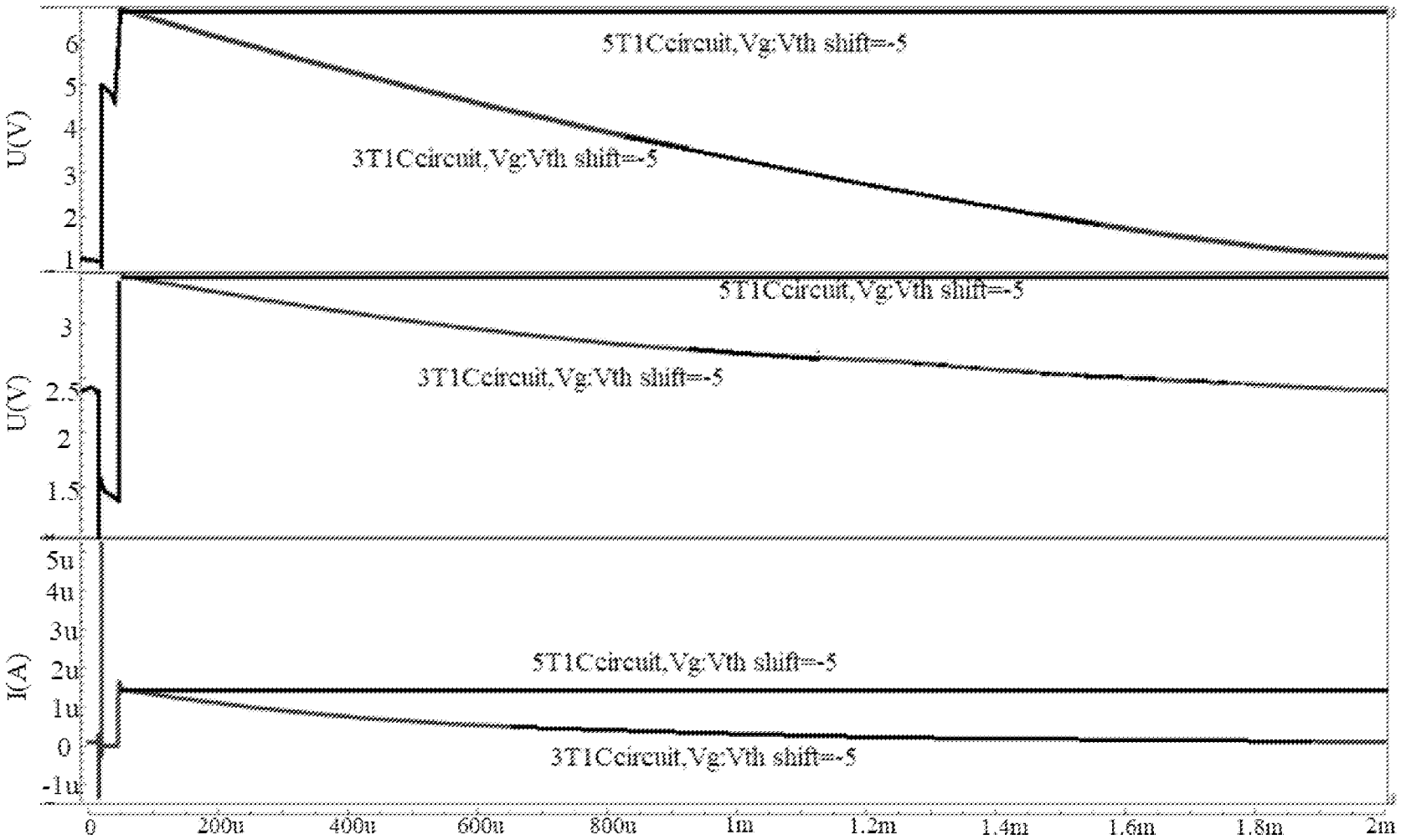
FIG. 5 is a time sequence diagram of the influences of negative biasing (Vth shift) of the threshold voltage of the second transistor T2 on an electric current flowing through an organic light emitting component.

FIG. 5 is a time sequence diagram of the influences of negative biasing (Vth shift) of a threshold voltage of a second transistor T2 on an electric current flowing through an organic light emitting component. From this, it can be understood that by reasonably adding the third transistor T3 and the fourth transistor T4 to transmit the power source voltage VDD to the third node N and reducing the drain electric current of the second transistor T2, although there exists severe negative biasing of the threshold voltage, the electric current flowing through the organic light emitting component remains even. The negative biasing of the threshold voltage of the switching transistor therefore does not cause data signal loss, thereby preventing occurrence of flickering of the organic light emitting component and ensuring the normal display of the screen.

An embodiment of the present disclosure further provides a display panel including the pixel driving circuit mentioned above.

Beneficial effects of the present disclosure are to provide a pixel driving circuit, a driving method thereof, and a display panel. By reasonably adding the third transistor T3 and the fourth transistor T4 to transmit the power source voltage VDD to the third node N, a drain electric current of the second transistor T2 can be reduced to be small, and severe negative biasing is unable to generate on the threshold voltage. The evenness of the electric current flowing through the organic light emitting component is ensured, data signal loss is prevented, occurrence of flickering of the organic light emitting components is prevented, and the normal display of the screen is ensured.

In the above embodiments, the description of each embodiment has its emphasis, and for some embodiments that may not be detailed, reference may be made to the relevant description of other embodiments.

The pixel driving circuit, the driving method thereof, and the display panel provided by the embodiments of present disclosure are described in detail above. This article uses specific cases for describing the principles and the embodiments of the present disclosure, and the description of the embodiments mentioned above is only for helping to understand the method and the core idea of the present disclosure. It should be understood by those skilled in the art, that it can perform changes in the technical solution of the embodiments mentioned above, or can perform equivalent replacements in part of technical characteristics, and the changes or replacements do not make the essence of the corresponding technical solution depart from the scope of the technical solution of each embodiment of the present disclosure.

What is claimed is:

1. A pixel driving circuit, comprising:

a first transistor, wherein a gate electrode of the first transistor is connected to a first node, a source electrode of the first transistor is connected to a second node, and a drain electrode of the first transistor is configured to receive a power source voltage;

a second transistor, wherein a gate electrode of the second transistor is configured to receive a writing signal, a source electrode of the second transistor is connected to a third node, and a drain electrode of the second transistor is connected to the first node;

a third transistor, wherein a gate electrode of the third transistor is connected to the gate electrode of the second transistor and is configured to receive the writing signal, a source electrode of the third transistor is configured to receive a data signal, and a drain electrode of the third transistor is connected to the third node;

a fourth transistor, wherein a gate electrode of the fourth transistor is configured to receive an enabling signal, a source electrode of the fourth transistor is connected to the third node, and a drain electrode of the fourth transistor is configured to receive the power source voltage;

a fifth transistor, wherein a gate electrode of the fifth transistor is configured to receive a read signal, a source electrode of the fifth transistor is configured to receive a sensing signal, and a drain electrode of the fifth transistor is connected to the second node;

a bootstrap capacitor, wherein one end of the bootstrap capacitor is connected to the first node, and another end of the bootstrap capacitor is connected to the second node; and an organic light emitting component, wherein an anode of the organic light emitting component is connected to the second node, and a cathode of the organic light emitting component is connected to a ground voltage.

2. The pixel driving circuit as claimed in claim 1, wherein:

the first transistor, the second transistor, the third transistor, the fourth transistor, and the fifth transistor are any one of a low-temperature polycrystalline-silicon thin film transistor, an oxide semiconductor thin film transistor, or an amorphous silicon thin film transistor.

3. The pixel driving circuit as claimed in claim 1, wherein the writing signal and the read signal are provided by an external time schedule controller.

4. The pixel driving circuit as claimed in claim 1, wherein the first transistor provides a constant driving electric current to the organic light emitting component.

5. A driving method of a pixel driving circuit that can drive the pixel driving circuit as claimed in claim 1, wherein the driving method comprises following steps of:

initializing the pixel driving circuit in an initial stage;

receiving the enabling signal of high electric potential by the gate electrode of the fourth transistor, transmitting the power source voltage to the third node under control of the enabling signal, and storing a threshold voltage of the first transistor in the bootstrap capacitor in a data input stage; and generating a driving electric current by the pixel driving circuit, which is provided to the organic light emitting component to drive a light emitting display of the organic light emitting component in a light emitting stage.

6. The driving method of the pixel driving circuit as claimed in claim 5, wherein the data input stage comprises steps of:

obtaining high electric potentials by the writing signal, the read signal, and the data signal, and the enabling signal and sensing signal being low electric potentials, turning on the first transistor, the second transistor, the third transistor, and the fifth transistor, keeping the fourth transistor turned off, writing the data signal to the first node, and writing the sensing signal to the second node in a first stage; and pulling down the writing signal to the low electric potential from the high electric potential, turning off the second transistor and the third transistor, raising the enabling signal meanwhile to the high electric potential, writing the power source voltage to the third node, and keeping a driving voltage at the second node in a second stage.

7. The driving method of the pixel driving circuit as claimed in claim 6, wherein the driving voltage is 1V.

8. The driving method of the pixel driving circuit as claimed in claim 5, wherein when entering the light emitting stage from the data input stage, the read signal is pulled down to the low electric potential from the high electric potential, the fifth transistor is turned off, electric potentials of the first node and the second node are raised simultaneously, an electric current passes through the first transistor and flows through the organic light emitting component, and the organic light emitting component continuously emits light.

9. The driving method of the pixel driving circuit as claimed in claim 5, wherein in the light emitting stage, the writing signal, the read signal, and the data signal obtain low electric potentials, and the organic light emitting component emits light.

10. A display panel, comprising the pixel driving circuit as claimed in claim 1.

* * * * *